US010939715B2

(12) United States Patent
Karr Johnson

(10) Patent No.: US 10,939,715 B2
(45) Date of Patent: Mar. 9, 2021

(54) HAIR WINDBREAKER

(71) Applicant: GBM Health, Inc., Thousand Oaks, CA (US)

(72) Inventor: Heather Karr Johnson, Santa Monica, CA (US)

(73) Assignee: GBM Health, Inc., Thousand Oaks, CA (US)

( * ) Notice: Subject to any disclaimer, the term of this patent is extended or adjusted under 35 U.S.C. 154(b) by 0 days.

(21) Appl. No.: 16/899,452

(22) Filed: Jun. 11, 2020

(65) Prior Publication Data

US 2020/0390178 A1 Dec. 17, 2020

Related U.S. Application Data

(60) Provisional application No. 62/860,014, filed on Jun. 11, 2019.

(51) Int. Cl.
*A42B 1/041* (2021.01)
*A42B 7/00* (2006.01)
*A42B 1/0186* (2021.01)

(52) U.S. Cl.
CPC ..... *A42B 1/041* (2013.01); *A42B 1/0186* (2021.01); *A42B 7/00* (2013.01)

(58) Field of Classification Search
CPC .... A42B 1/12; A42B 1/16; A42B 1/06; A42B 1/041; A42B 1/043; A42B 1/045; A42B 1/066; A42B 1/067; A42B 1/18
USPC ..... 2/174, 204, 175.6
See application file for complete search history.

(56) References Cited

U.S. PATENT DOCUMENTS

| | | | | |
|---|---|---|---|---|
| 2,708,273 A | | 5/1955 | Bonaventura | |
| 3,144,662 A | | 8/1964 | Gettinger | |
| 3,231,900 A | | 2/1966 | Gettinger | |
| 3,238,536 A | | 3/1966 | Gettinger | |
| 3,480,970 A | | 12/1969 | Gettinger | |
| 4,378,606 A | * | 4/1983 | Snowden | A42B 1/041 2/200.1 |
| 5,083,318 A | | 1/1992 | Hook | |
| 5,832,538 A | * | 11/1998 | Williams | A42B 1/045 2/202 |
| 5,875,493 A | * | 3/1999 | MacDonald | A01K 55/00 2/10 |
| 6,948,190 B2 | * | 9/2005 | McGreggor | A42B 1/041 2/202 |

(Continued)

OTHER PUBLICATIONS

Wrapunzel, Wrapunzel Signature Scarf, https://wrapunzel.com/store/, 2020, 3 pages.

(Continued)

*Primary Examiner* — Alissa L Hoey
*Assistant Examiner* — Patrick J. Lynch
(74) *Attorney, Agent, or Firm* — SoCal IP Law Group LLP; Guy Cumberbatch; Steven C. Sereboff

(57) ABSTRACT

A hair covering to protect styled, typically long, hair from the effects of excessive wind. The hair covering is made of lightweight fabric such as thin nylon often used for windbreaker jackets, and thus the hair covering is termed a hair windbreaker. The hair windbreaker is especially beneficial for women with long hair, especially those who have just had an expensive salon styling and do not wish to muss their hair up. The hair windbreaker has an adjustably-sized head opening and may have an adjustably-sized hair opening.

20 Claims, 9 Drawing Sheets

(56) References Cited

U.S. PATENT DOCUMENTS

| | | | | |
|---|---|---|---|---|
| D624,284 | S * | 9/2010 | Creel | D2/867 |
| 8,516,619 | B2 | 8/2013 | Absi et al. | |
| D795,537 | S | 8/2017 | Yates | |
| 2003/0221243 | A1* | 12/2003 | Phillips | A42B 1/041 2/202 |
| 2006/0272073 | A1* | 12/2006 | Marquardt | A42B 1/043 2/171 |
| 2009/0151048 | A1* | 6/2009 | Laury | A45D 44/00 2/202 |
| 2010/0064418 | A1* | 3/2010 | Graham | A42B 1/041 2/206 |
| 2012/0317699 | A1* | 12/2012 | Barr | A42B 1/067 2/209.13 |
| 2015/0209621 | A1* | 7/2015 | Cason | A42B 1/24 2/68 |
| 2017/0245567 | A1* | 8/2017 | Fathollahi | H02J 7/342 |
| 2018/0077988 | A1* | 3/2018 | Thomas | A42B 1/04 |

OTHER PUBLICATIONS

USA Fashion Accessories, Enjoy Holiday 1981 Satin Silk Lined Sleep Cap Beanie Slap Hat—Bamboo Outer, https://www.amazon.com/Enjoy-Holidays-1981-Satin-Beanie/dp/B07X1WLDH8, Jun. 5, 2020, 3 pages.

Headcovers Unlimited, Inc., Religious Head Coverings Guide, https://www.headcovers.com/resources/hats-scarves/religious-head-coverings/, May 18, 2020, 10 pages.

* cited by examiner

HAIR WINDBREAKER

RELATED APPLICATION INFORMATION

This patent application claims priority from U.S. Provisional Application Ser. No. 62/860,014, filed Jun. 11, 2019, entitled HAIR COVERING, the contents of which are expressly incorporated herein by reference.

NOTICE OF COPYRIGHT AND TRADE DRESS

A portion of the disclosure of this patent document contains material which is subject to copyright protection. This patent document may show and/or describe matter which is or may become trade dress of the owner. The copyright and trade dress owner have no objection to the facsimile reproduction by anyone of the patent disclosure as it appears in the Patent and Trademark Office patent files or records, but otherwise reserves all copyright and trade dress rights whatsoever.

FIELD

The present application relates to a lightweight hair covering that acts as a hair windbreaker.

BACKGROUND

Convertibles, boats, crew ship decks, the beach, long walks from the parking lot to work in the rain, etc., are a nightmare for women with styled hair. Various problems arise in such situations, not the least of which is a bad hair day from then on. In worst-case scenarios, hair flying in the face distracts drivers and limits vision, or the hair simply gets stuck on lip gloss by whipping around the face. These problems often limit people in general, and women in particular, from engaging in such otherwise simple enjoyable activities such as driving in a convertible. Indeed, many women do not buy convertibles because of this issue with tangled hair after a ride, and often discourage their husbands or boyfriends from buying a convertible.

Various solutions are available going back to simple scarves worn by icons such as Katharine Hepburn and Jackie Onassis. For example, a ponytail or head band can prevent a lot of issues. However, such solutions, even scarves, are not optimal because they flatten, compress, dent or otherwise distort styled hair. Most wraps or hair bunching solutions will alter the hairstyle and thus are not an option for someone with styled hair, especially expensively styled hair. Moreover, even the hair control solutions that exist don't control all the hair. Even if you were wearing a baseball cap and a ponytail there is always some hair that is whipping your face.

Consequently, though there are hair coverings presently available, there remains a need for a hair covering which protects coiffed hair from the wind and elements without distorting the hairstyle from excessive constriction.

SUMMARY OF THE INVENTION

A first hair windbreaker as disclosed herein has a stretch of lightweight fabric defining a front edge and a rear edge that together define a periphery of an opening into a hair pocket for loosely containing and protecting from the wind a person's long hair. A head band with an adjustable circumference attaches along the front edge and continues across the opening into the hair pocket between the front and rear edges. An adjustable hair opening formed by the rear edge is configured to adjustably secure the rear edge around a person's hair adjacent the scalp.

A second hair windbreaker, comprises a head band with an adjustable circumference and a stretch of lightweight fabric having a front edge that attaches around at least 90° around a front of the head band. The stretch of fabric extends rearward from the front edge beyond a rear portion of the head band to a rear edge. The rearward stretch of fabric forms a hair pocket for loosely containing and protecting from the wind a person's long hair. The stretch of fabric forms an adjustable hair opening, and a closure for the adjustable hair opening adjustably secures the rear edge around a person's hair adjacent the scalp.

A third hair windbreaker defines a cap defined by a head band with an adjustable circumference. A stretch of lightweight fabric having a U-shaped front edge attaches along a front portion of the head band to two spaced apart points defining terminal ends of the front edge. The stretch of lightweight fabric extends rearward around a U-shaped rear edge having an adjustable hair opening. The rear edge commences at two spaced apart points defining forward ends thereof, and each of the forward ends is located in close proximity to one of the terminal ends of the front edge with portions of the fabric therebetween. The stretch of lightweight fabric is large enough to define a hair pocket for loosely containing and protecting from the wind a person's long hair. Finally, a closure for the adjustable hair opening of the rear edge adjustably secures the rear edge around a person's hair adjacent the scalp.

The lightweight fabric may be nylon, and the stretch of lightweight fabric may be pleated adjacent the head band so that a midportion of the hair pocket can billow outward to accommodate more hair. The hair windbreaker may have a brim extending forward from the front edge of the stretch of lightweight fabric. The hair windbreaker may further including a tunnel-like sleeve formed along the rear edge of the stretch of lightweight fabric and a tie that extends through the sleeve and emerges at free ends, wherein the free ends are configured to form the closure across the opening into the hair pocket between the front and rear edges so as to define a maximum size of the adjustable hair opening. The free ends may be tied, snapped, buttoned or provided with mating hook and loop fastener (i.e., VELCRO®) patches to form the closure.

DETAILED DESCRIPTION OF A PREFERRED EMBODIMENT

The present application provides an improved hair covering to protect styled, typically long, hair from the effects of excessive wind. The hair covering is made of lightweight fabric such as thin nylon often used for windbreaker jackets, and thus the hair covering is termed a hair windbreaker. The hair windbreaker is especially beneficial for women with long hair, especially those who have just had an expensive salon styling and do not wish to muss their hair up. However, the hair windbreaker is also useful for women with shorter hair, and also men who do not wish their hairstyle to be unduly affected by excessive wind. For the purpose of definition, the term "long hair" will be hair extends more than 3 inches below the hair line at the back of the neck.

Figure 1:
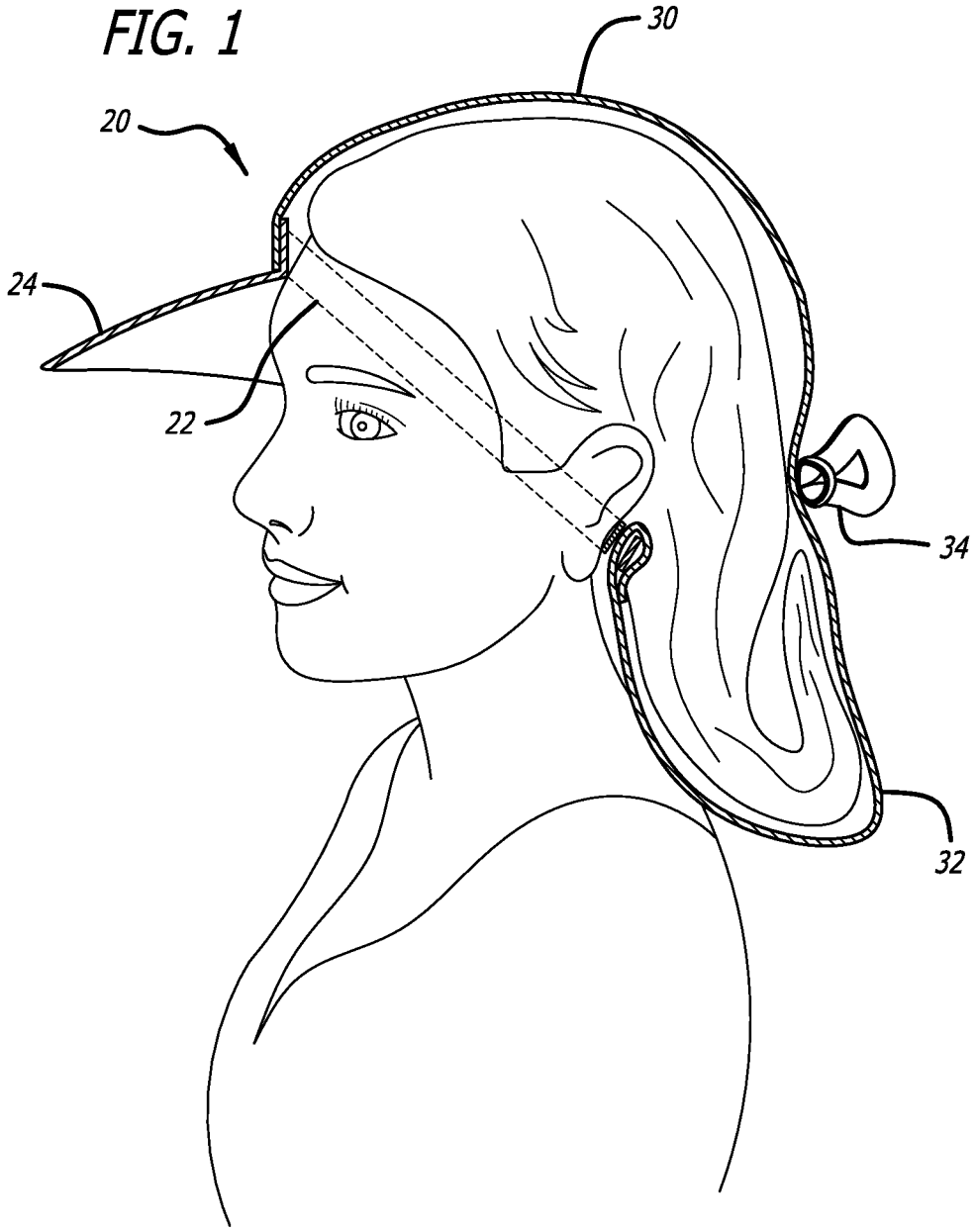
FIG. 1 is a side view of a woman wearing a hair windbreaker as disclosed herein shown in sectional view.

FIG. 1 is a side view of a woman wearing a hair windbreaker 20 as disclosed herein shown in sectional view. The hair windbreaker 20 includes an adjustable head band 22 similar to those in baseball caps and the like. A visor or brim 24 may be connected at a front of the head band 22 to provide shade for the person's eyes.

Figure 2:
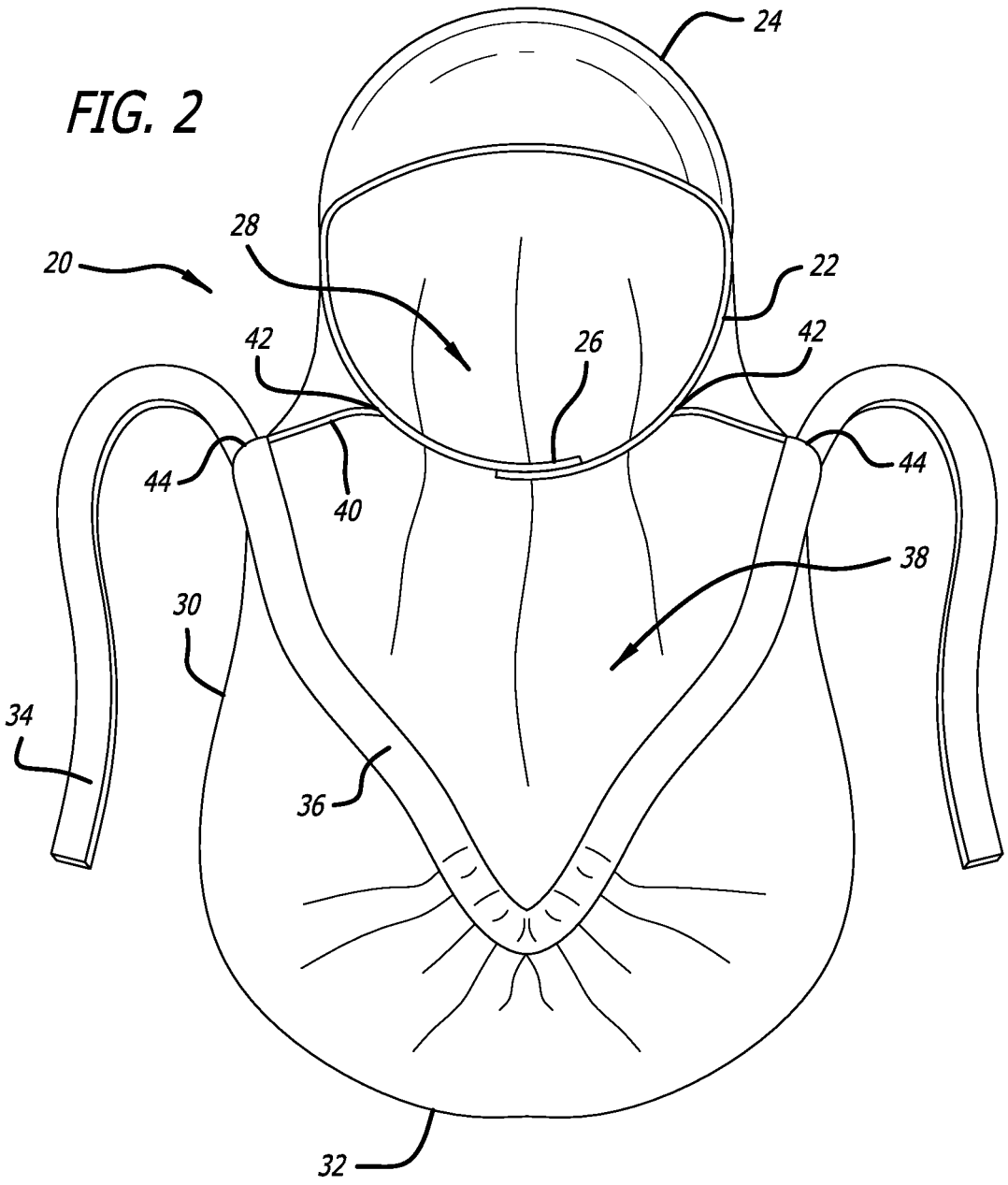
FIG. 2 is a bottom plan view of the exemplary hair windbreaker having two adjustable openings.

FIG. 2 is a bottom plan view of the exemplary hair windbreaker 20 having two adjustable openings. The head band 22 is typically adjustable at a rear closure 26 formed by straps having mating hook and loop fasteners (i.e., VELCRO®), buckles, snaps, buttons or similar expedients. The adjustably sized head band 22 defines a head opening 28 for the hair windbreaker 20.

One or more continuous enlarged fabric panels 30 attach around the head band 22 and extend rearward into an enlarged pocket for containing the hair. More particularly, and as seen in FIG. 1, the fabric panel(s) 30 forms an upper head portion that surrounds the person's head, as well as a lower pocket portion 32 that extends a distance down the wearer's back. The head portion and the head band 22 and brim 24 form a cap of sorts, though the rear of the cap opens to the rear hair pocket. The fabric panel(s) 30 is sewn around a front portion of the head band 22, preferably around at least 90° around the head band, and more preferably about 270° around. The fabric panel(s) 30 may be formed of a single panel, but are typically formed by several adjacent panels sewn along longitudinal seams, which simplifies fabrication. The loose, billowing shape formed will be termed a stretch of fabric 30. Free ends of an elongated tie 34 are provided to secure around the otherwise loose fabric 30 for control, as will be seen below.

The stretch of fabric 30 has a U-shaped front edge attached along the front of the head band 22 and a U-shaped rear edge that together define a periphery of a large opening into a hair pocket for loosely containing and protecting from the wind a person's long hair. In this embodiment, the large opening is divided into two, the head opening 28 for the head and one for the hair. At the rear, the rear closure 26 of the head band 22 extends across the opening into the hair pocket so as to roughly divide the opening in half.

FIG. 2 shows an elongated tunnel-like sleeve 36 formed along the U-shaped rear edge of the stretch of fabric 30 and partially defining a second opening 38 for the hair. The hair opening 38 is bordered on a rear side by the tunnel-like sleeve 36 and at the front side by short pieces of connecting fabric 40 that attach to rear sides of the head band 22, and the rear edge of the head band 22 itself. Rear ends 42 of the U-shaped front edge of the stretch of fabric 30 are defined where the pieces of connecting fabric 40 meet the head band 22. The pieces of connecting fabric 40 are desirably folded and a seam sewn therealong so as to create a durable edge. The elongated tie 34 extends through the sleeve 36 and its free ends may be pulled to cinch or narrow the hair opening 38. The rear edge of the stretch of fabric 30 commences at two spaced apart points where the sleeve 36 ends defining forward ends 44 of the rear edge. Each of these forward ends 44 of the fabric rear edge is located in close proximity to one of the terminal rear ends 42 of the front edge, for example within 2-3 inches. The pieces of connecting fabric 40 extend therebetween.

The hair windbreaker 20 has the head opening 28 and the hair opening 38 so that it can be secured on the person's head using the head band 22 while gently encompassing the wearer's hair within the stretch of fabric 30 and especially the lower pocket 32 thereof. To avoid crimping, or otherwise damaging the person's hair, the hair windbreaker 20 is held on the head mainly by the head opening 28 extending from the person's forehead and generally under the hairline around the back of the neck. A process for putting on the hair windbreaker 20 is described below.

Figure 3A:
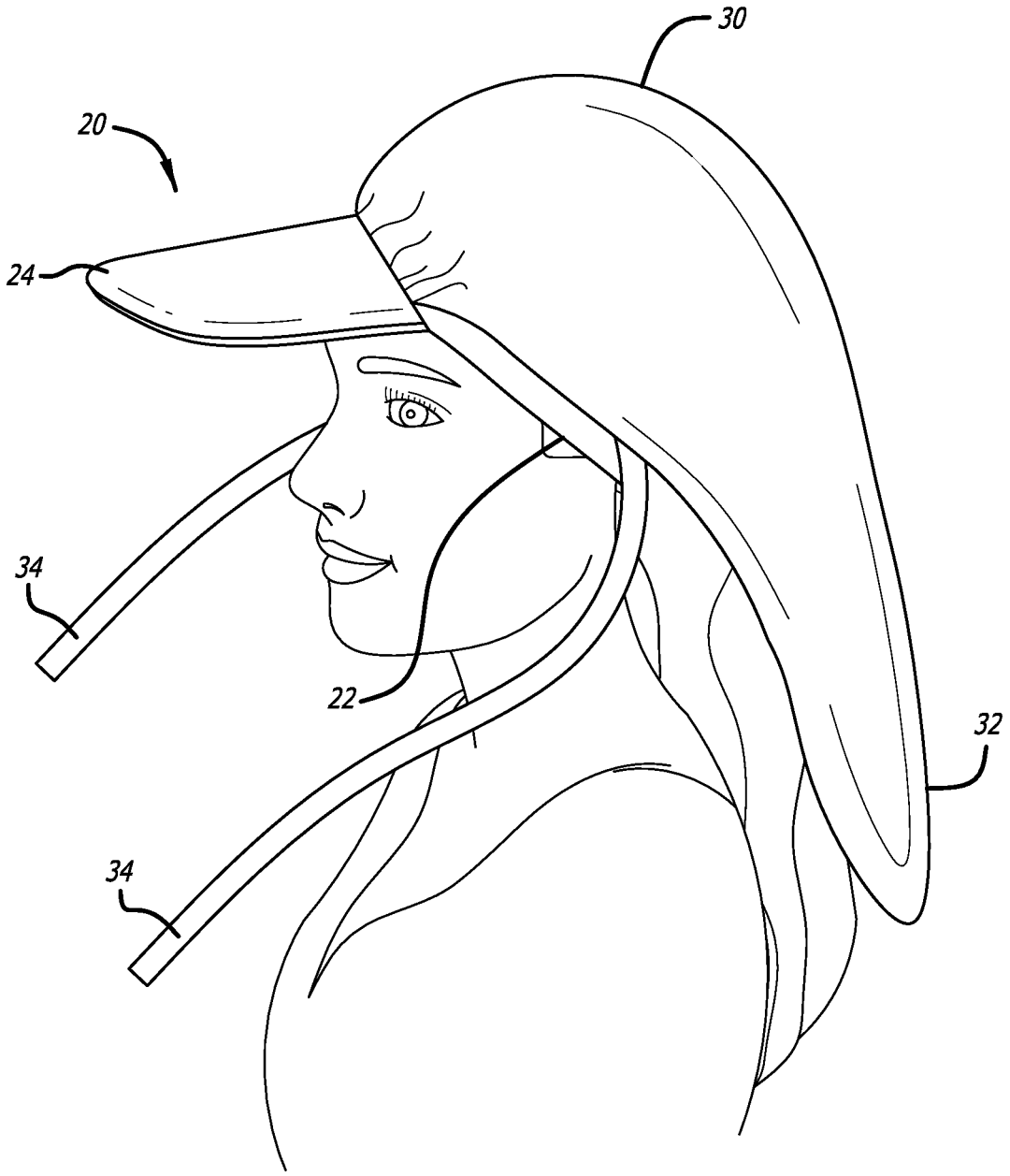
FIGS. 3A-3E are side views of a woman showing several steps in donning the hair windbreaker disclosed herein.
Figure 3B:
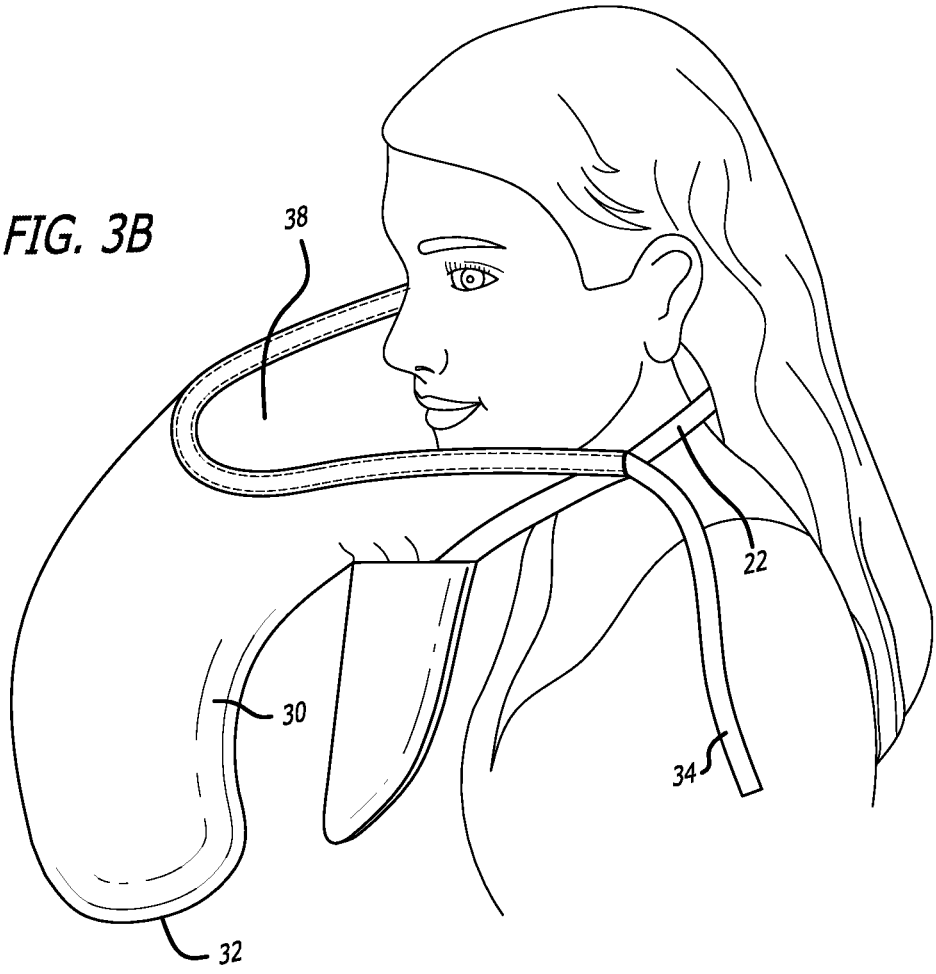

FIGS. 3A-3E are side views of a woman showing several steps in donning the hair windbreaker 20. Initially, as seen in FIG. 3A, the wearer gently places the hair windbreaker 20 on top of the head with the brim 24 facing forward. Subsequently, as seen in FIG. 3B, the stretch of fabric 30 including the head portion and pocket 32 is rotated around to the front of the person's head. By either disconnecting and repositioning/reconnecting the free ends of the head band 22 or simply pulling the hair out from under the head band 22, the wearer moves the rear of the head band underneath the hair as shown.

Figure 3C:
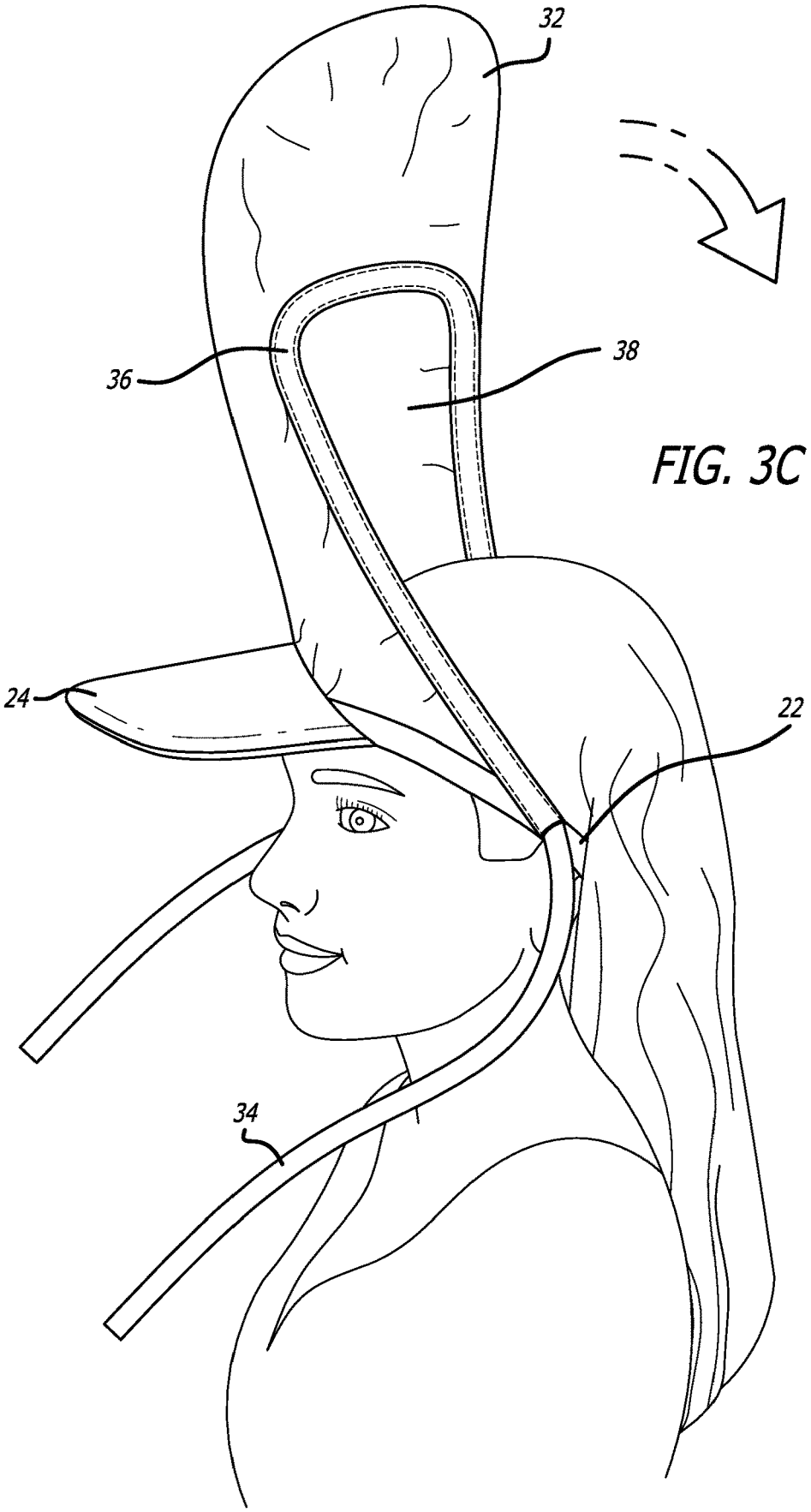

FIG. 3C then shows rotation of the stretch of fabric 30 over to the backside of the wearer's head. The hair opening 38 is seen in a widened configuration which can be accomplished by manually pulling on the fabric sleeve 36 around the opening which retracts the free ends of the tie 34 into the sleeve 36. The hair opening 38 can preferably open extremely wide so as to accommodate a large volume of long hair. For example, the hair opening 38 can be expanded to form a circular opening having a diameter of at least 6 inches, and potentially up to 10-12 inches. However, because of the elongated tie 34 or other such closure, the hair opening 38 can be cinched closed to protect the wearer's hair, as will be shown below.

Figure 3D:
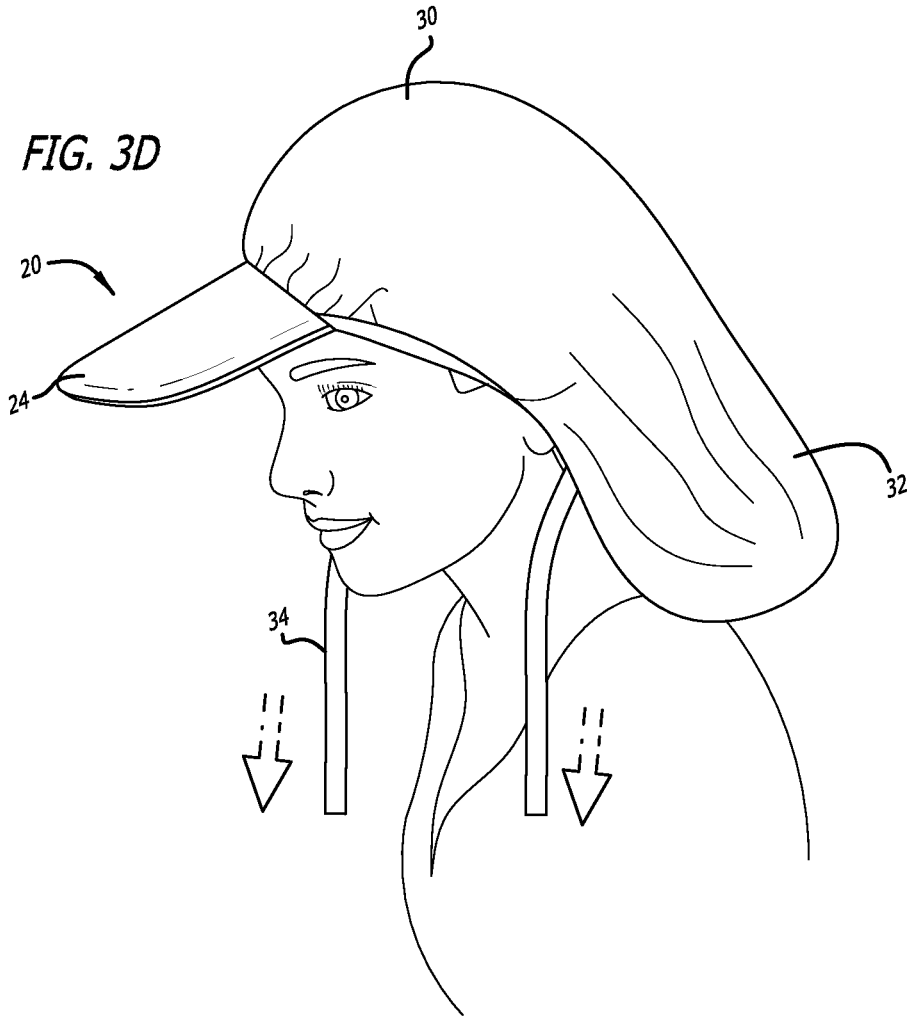

FIG. 3D now shows the stretch of fabric 30 draped over the rear of the wearer's head and after the wearer has inserted her hair through the hair opening 38 and into the pocket 32 formed by the stretch of fabric 30. As explained, the hair opening 38 can be opened extremely wide, which facilitates this operation. The user's hair is now loosely collected within the pocket 32. The stretch of fabric 30 that forms the head portion and pocket 32 may be pleated adjacent to the edges connected to the head band 22 and around the fabric sleeve 36. FIG. 3A shows some of the pleats where the fabric 30 meets the brim 24. This allows the midportions of the stretch of fabric 30 to be larger in volume, in the sense of billowing outward, than would an unpleated pocket. This provides an increased volume within which to place the hair. At the same time, the lightweight relatively tightly woven fabric such as nylon does not exert pressure on the hair and protects against the wind. The hair is protected within the fabric pocket 32.

The size of the fabric pocket 32 formed by the stretch of fabric 30 may vary, but is preferably large enough to contain relatively long hair. For example, the length of the head portion and pocket 32 extending rearward from the head band 22 may be greater than 1 foot, and is preferably between 1-2 feet. At the same time, the volume defined within the head portion and pocket 32 is sufficient to loosely surround and protect the largest hairdos. For lack of a measurement scale, the interior volume of the head portion and pocket 32 is preferably at least a cubic foot, and preferably between 1-1.5 $ft^3$, or between about 0.1-0.2 cubic liters. Another measure of the size of the pocket 32 is the length of the hair windbreaker 20 that extends down in the rear when worn on the head. In one example, the pocket 32 extends down the wearer's back about 6-12 inches, though longer pockets are contemplated for longer hair.

Figure 3E:
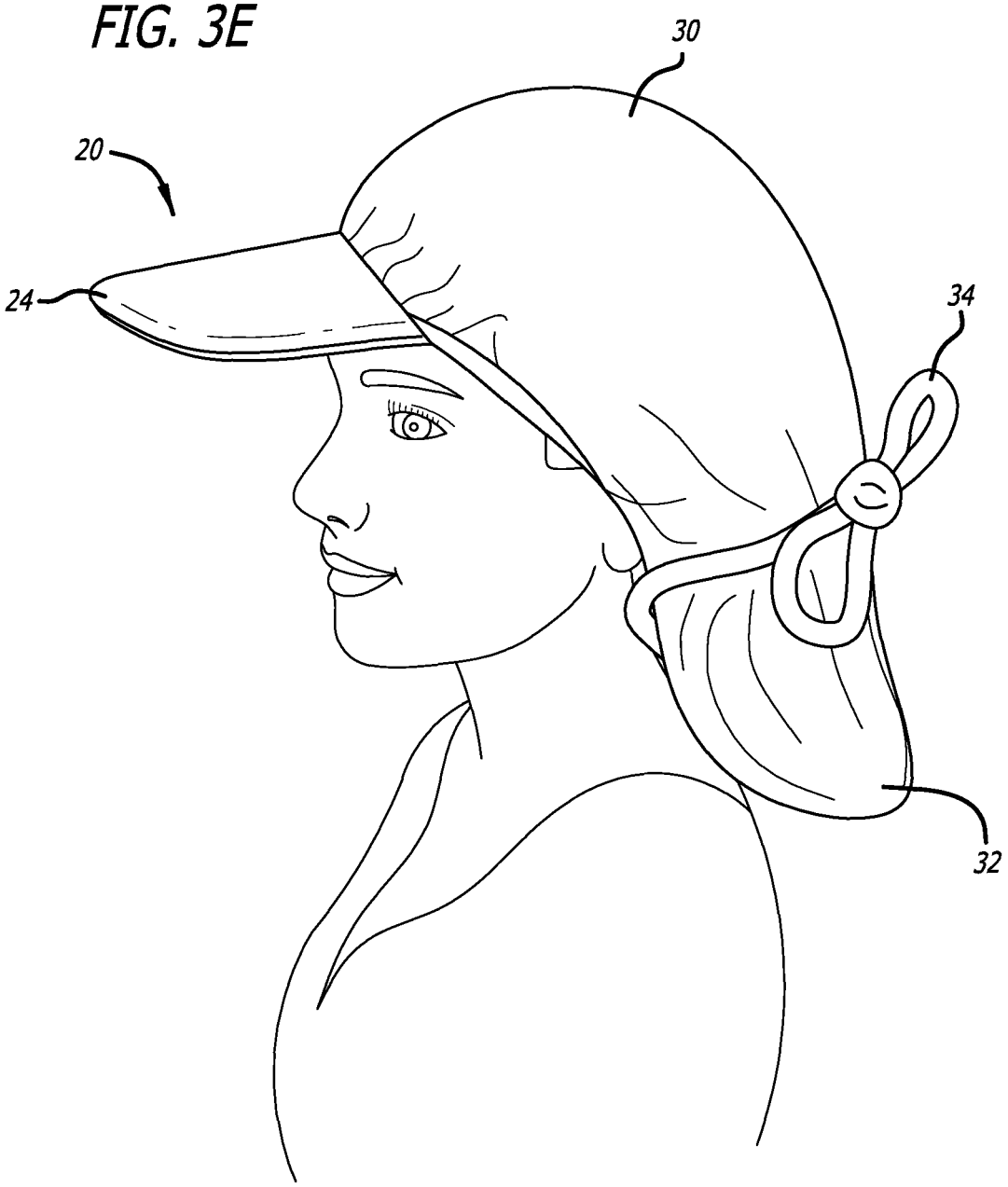

Finally, FIG. 3E shows the elongated tie 34 secured over the top of the stretch of fabric 30. That is, the free ends of the tie 34 are looped around the outside of the hair windbreaker 20 and secured. It should be understood that the closure defined by the tie 34 can be made by any number of known fabric closures. For example, two straps having mating hook and loop fastener (i.e., VELCRO®) patches can be used, or straps having buttons, snaps, or magnetic fasteners, or even a buckle-like configuration. The important aspect is that the enclosure 34 cinches the hair opening 38 closed and then loosely secures around the outside of the hair windbreaker. The intent is not to tighten around the hair windbreaker, but instead just secure the loose ends of the closure 34.

With reference back to the bottom view of FIG. 2, the advantageous nature of the hair opening 38 will be more readily apparent. Namely, the elongated tie 34 can be cinched to reduce the size of the hair opening 38. Due to the short length of the connecting fabric 40 on each side extending between the sleeve 36 defining the hair opening 38 and the head band 22, very little air can force its way into the pocket where the hair is protected.

Figure 4:
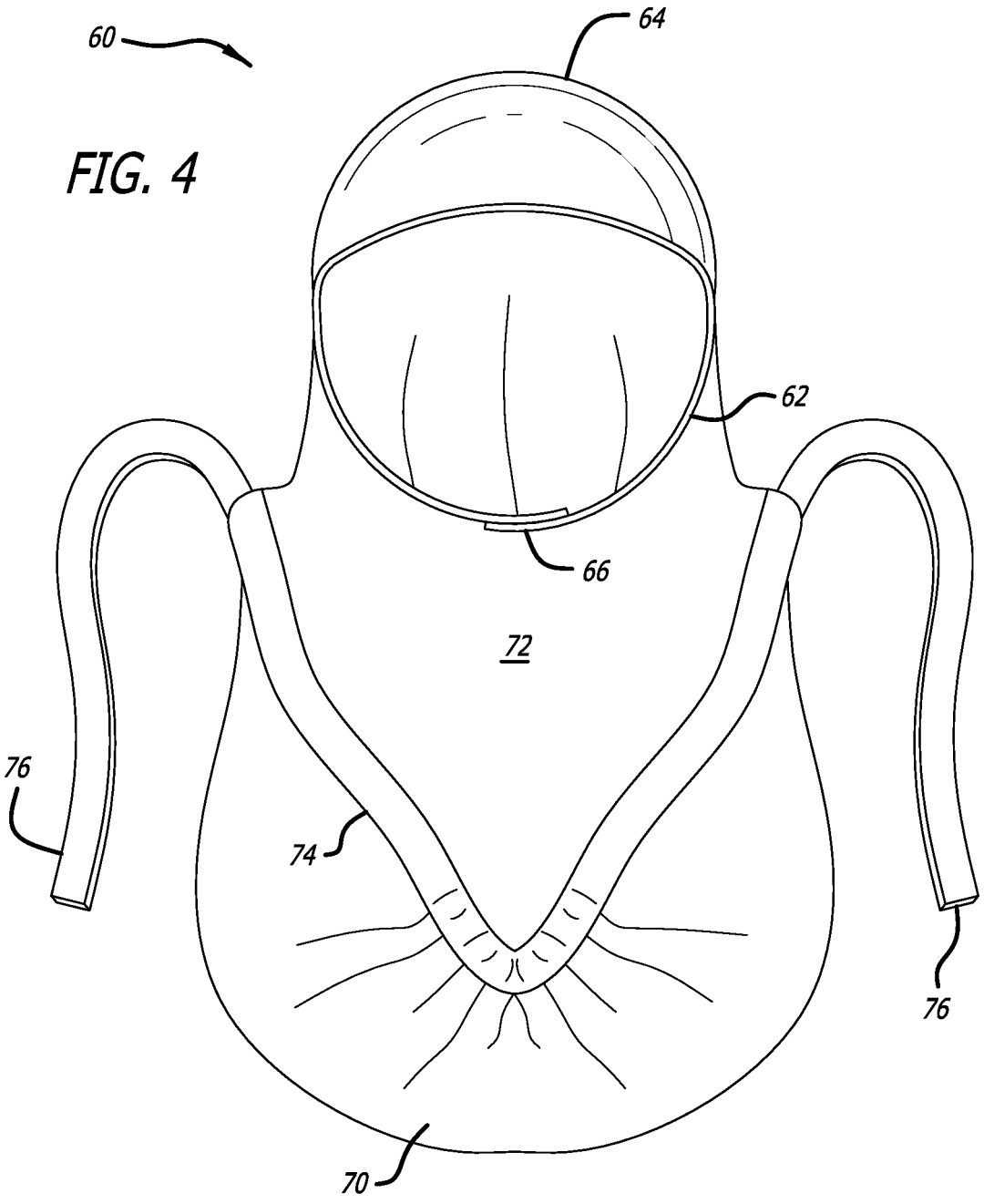
FIG. 4 is a bottom plan view of an alternative hair windbreaker of the present application.

FIG. 4 is a bottom plan view of an alternative hair windbreaker 60 of the present application. The hair windbreaker 60 again includes a head band 62 having a visor or brim 64 projecting forward therefrom. The head band 62 is again adjustable at a rear closure 66. Also as before, the hair windbreaker 60 has an elongated panel attached to the head band 62 and adapted to drape down the back of the wearer to contain the wearer's hair in an enlarged pocket 70.

In contrast to the earlier embodiment, the windbreaker 60 does not define a hair opening in addition to the head band 62. Instead, a panel 72 of fabric attaches between the rear of the head band 62 and a tunnel-like sleeve 74 that receives an elongated tie 76. As mentioned above, the tie 76 can be replaced with other closures such as mating hook and loop fasteners (i.e., VELCRO®) and the like. Instead of using the exact procedure described above with respect to FIGS. 3A-3E, the wearer simply enlarges the head opening 62 by disconnecting the closure 66 and inserting her hair through the head opening and into the pocket 70. Then the head band 62 can be once again closed underneath the hair. This process is simpler, although including a hair opening as above is believed to provide the greatest protection against distorted or even damaging carefully coiffed hair.

Figure 5:
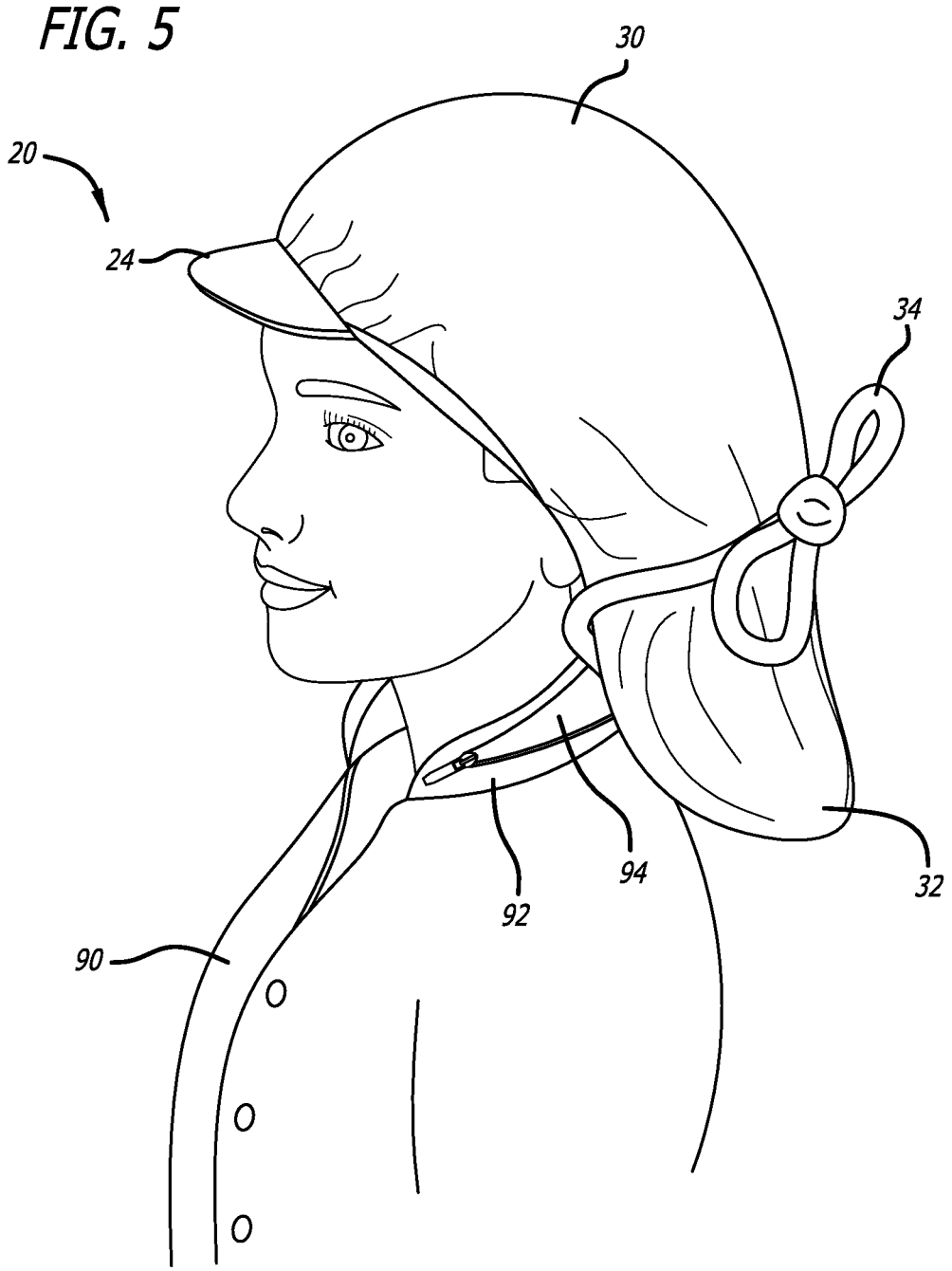
FIG. 5 is a side view of a woman wearing a jacket with a hair windbreaker incorporated therein.

In addition to a stand-alone item, the hair windbreaker may also be incorporated into an article of clothing such as a jacket. FIG. 5 is a side view of a woman wearing a jacket 90 with a hair windbreaker 20 incorporated therein. The jacket 90 includes a pouch 92 formed around the back side of the neck area which may have a zippered opening 94. The thin fabric of the windbreaker 20 enables it to be rolled up and inserted into the pouch 92 when not in use. The brim 24 may be reduced in size to better fit into the pouch 92. The user then need only unzip the opening 94 and pull out the windbreaker 20. The windbreaker 20 may be attached at one or more points within the pouch 92 to prevent separation from the jacket 90.

When placed around the hair, the hair windbreakers as described here effectively protect the hair without compressing, distorting or otherwise creasing styled hair. Drivers wearing the hair windbreaker will not be distracted by hairs flying in their faces. In addition to safety, the hair windbreaker prevents discomforts such as hair getting stuck to lip gloss, becoming dirty or smoky, and wet in the rain. When adjusted properly, the hair windbreaker applies very little pressure to the hair due to the extremely lightweight fabric that defines the pocket. As mentioned, thin nylon is preferred, though other similar polymer material such as polyester, micro polyester, and the like can be used. The only pressure around the wearer's head is imparted by the head band 22, 62 which lies against the forehead and then around the back of the neck under the hair. As long as all of the hair is placed within the pocket, the head band will not distort the hairstyle.

Although a visor or brim is shown in both embodiments, the brim is primarily useful for shade and as a handle in donning the hair windbreaker. The brim is desirably sized small enough so as to not catch the wind. The head band is preferably relatively narrow in the height dimension so as to make as little skin contact as possible. For example, the head band is desirably less than 1 inch in the height dimension. Padding may be added to the inside of the head band to increase comfort. For example, 100% cotton fleece maybe secured around the head band except for at the rear closure so as to minimize any residual marks left on the forehead.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

It is claimed:

1. A hair windbreaker, comprising:

a) a stretch of fabric of nylon, polyester, or micro polyester having a front edge and a U-shaped rear edge that together define a periphery of an opening into a hair pocket defined by the stretch of fabric for containing and protecting a person's long hair from wind;

b) a head band with an adjustable circumference attached along the front edge and continuing across the opening into the hair pocket between the front and rear edges, the front edge terminating at rear ends attached to the head band; and c) an adjustable hair opening formed by the rear edge configured to adjustably secure the rear edge around the person's long hair adjacent the scalp, and a closure disposed along the rear edge configured to be loosened and permit the hair opening to expand to form a circular opening with a diameter of at least 6 inches up to 10-12 inches and conversely to be manually cinched to close the hair opening, further including a sleeve formed along the rear edge of the stretch of fabric and a tie that extends through the sleeve and emerges at the free ends, wherein the tie is dimensioned so the free ends extend around outside of the hair pocket and the tie and free ends are configured to loosely surround the hair pocket and form the closure, and wherein the sleeve commences at two spaced apart points defining forward ends of the rear edge of the stretch of fabric, each of the forward ends being spaced from one of the rear ends of the front edge with connecting portions of the stretch of fabric therebetween.

2. The hair windbreaker of claim 1, wherein the fabric is nylon.

3. The hair windbreaker of claim 1, wherein the stretch of fabric is pleated adjacent the head band so that a midportion of the hair pocket can billow outward.

4. The hair windbreaker of claim 1, further including a brim extending forward from the front edge of the stretch of fabric.

5. The hair windbreaker of claim 1, wherein the free ends are configured with mating buckles, snaps, buttons, or magnetic fasteners to form the closure.

6. The hair windbreaker of claim 1, wherein the free ends are configured to be tied or have mating hook and loop fastener patches to form the closure.

7. The hair windbreaker of claim 1, wherein the windbreaker is secured to a pouch at a neck region of a jacket.

8. A hair windbreaker, comprising:

a) a head band with an adjustable circumference;

b) a stretch of fabric of nylon, polyester, or micro polyester having a front edge that attaches circumferentially around at least 90° of a front of the head band to terminate at rear ends attached to the head band, the stretch of fabric extending rearward from the front edge beyond a rear portion of the head band and forming a U-shaped rear edge, the rearward extending stretch of fabric forming a hair pocket for containing and protecting a person's long hair from wind, the stretch of fabric forming an adjustable hair opening; and c) a closure for the adjustable hair opening of the rear edge configured to adjustably secure the rear edge around the person's long hair adjacent the scalp, the closure having two free ends of a tie configured to be loosened and permit the hair opening to expand to form a circular opening with a diameter of at least 6 inches up to 10-12 inches and conversely to be manually cinched to close the hair opening, further including a sleeve formed along the rear edge of the stretch of fabric and a tie that extends through the sleeve and emerges at the free ends, wherein the tie is dimensioned so the free ends extend around outside of the hair pocket and the tie and free ends are configured to loosely surround the hair pocket and form the closure, wherein the sleeve commences at two spaced apart points defining forward ends of the rear edge of the stretch of fabric, each of the forward ends being spaced from one of the rear ends of the front edge with connecting portions of the stretch of fabric therebetween.

9. The hair windbreaker of claim 8, wherein the fabric is nylon.

10. The hair windbreaker of claim 8, wherein the stretch of fabric is pleated adjacent the front of the head band so that a midportion of the hair pocket can billow outward.

11. The hair windbreaker of claim 8, further including a brim extending forward from the front edge of the stretch of fabric.

12. The hair windbreaker of claim 8, wherein the free ends are configured with mating buckles, snaps, buttons, or magnetic fasteners to form the closure.

13. The hair windbreaker of claim 8, wherein the free ends are configured to be tied to form the closure.

14. The hair windbreaker of claim 8, wherein the free ends have mating hook and loop fastener patches to form the closure.

15. A hair windbreaker, comprising:

a) a cap defined by a head band with an adjustable circumference;

b) a stretch of fabric of nylon, polyester, or micro polyester having a U-shaped front edge that attaches along a front portion of the head band to two spaced apart points defining rear ends of the front edge, the stretch of fabric extending rearward and forming a U-shaped rear edge having an adjustable hair opening, the rear edge commencing at two spaced apart points defining forward ends of the rear edge, each of the forward ends being spaced from one of the rear ends of the front edge with connecting portions of the stretch of fabric therebetween, wherein the rear ends of the front edge of the stretch of fabric are defined where the connecting portions of fabric meet the head band, wherein the stretch of fabric is dimensioned to define a hair pocket for containing and protecting a person's long hair from wind; and c) a closure for the adjustable hair opening of the rear edge configured to adjustably secure the rear edge around a person's hair adjacent the scalp, the closure configured to be loosened and permit the hair opening to expand to form a circular opening with a diameter of at least 6 inches up to 10-12 inches and conversely to be manually cinched to close the hair opening, further including a sleeve formed along the rear edge of the stretch of fabric and a tie that extends through the sleeve and emerges at free ends, wherein the tie is dimensioned so the free ends extend around outside of the hair pocket and the tie and free ends are configured to loosely surround the hair pocket and form the closure.

16. The hair windbreaker of claim 15, wherein the fabric is nylon.

17. The hair windbreaker of claim 15, wherein the stretch of fabric is pleated adjacent a front portion of the head band so that a midportion of the hair pocket can billow outward.

18. The hair windbreaker of claim 15, further including a brim extending forward from the front edge of the stretch of fabric.

19. The hair windbreaker of claim 15, wherein the free ends are configured with mating buckles, snaps, buttons, or magnetic fasteners to form the closure.

20. The hair windbreaker of claim 15, wherein the free ends are configured to be tied or secured with a mating hook and loop fastener to form the closure.

* * * * *